United States Patent [19]

Fujimoto

[11] 4,236,707

[45] Dec. 2, 1980

[54] PNEUMATIC SHEET FEEDER

[75] Inventor: Sakae Fujimoto, Chofu, Japan

[73] Assignee: Ricoh Company, Ltd., Japan

[21] Appl. No.: 918,076

[22] Filed: Jun. 22, 1978

[30] Foreign Application Priority Data

| | | | |
|---|---|---|---|
| Jun. 30, 1977 | [JP] | Japan | 52-78349 |
| Jun. 30, 1977 | [JP] | Japan | 52-78350 |
| Jun. 30, 1977 | [JP] | Japan | 52-78351 |
| Jun. 30, 1977 | [JP] | Japan | 52-78352 |
| Jul. 8, 1977 | [JP] | Japan | 52-81747 |
| Jul. 8, 1977 | [JP] | Japan | 52-81748 |

[51] Int. Cl.[3] ..... B65H 3/08; B65H 3/06

[52] U.S. Cl. ..... 271/11; 271/103; 271/107; 271/112

[58] Field of Search ..... 271/112, 103, 104, 106, 271/11, 12, 13, 14, 15, 107, 90, 121; 221/211; 414/121

[56] References Cited

U.S. PATENT DOCUMENTS

| | | | |
|---|---|---|---|
| 175,487 | 3/1876 | Myers | 271/121 |
| 3,465,129 | 9/1969 | Mitchell | 271/11 X |
| 3,620,527 | 11/1971 | Tyler et al. | 271/112 |
| 3,715,118 | 2/1973 | Larson | 271/103 |
| 3,730,513 | 5/1973 | Colombini | 271/12 X |
| 3,764,133 | 10/1973 | Gray et al. | 271/103 |
| 3,964,740 | 6/1976 | Lamb | 271/11 |

*Primary Examiner*—Bruce H. Stoner, Jr.
*Attorney, Agent, or Firm*—McGlew and Tuttle

[57] ABSTRACT

A pneumatic sheet feeder includes a movable bottom plate which is disposed to form a constant angle with the uppermost sheet in a stack placed on a sheet receptacle, irrespective of the height of the stack. Sheets on the receptacle are attracted one by one by a negative pressure to be sequentially fed by a feed roller which is driven for rotation in an automatic manner.

29 Claims, 21 Drawing Figures

PNEUMATIC SHEET FEEDER

BACKGROUND OF THE INVENTION

The invention relates to a pneumatic sheet feeder.

U.S. Pat. No. 3,964,740, for example, discloses a pneumatic sheet feeder which may be used in a copying machine or facsimile system. The feeder comprises a sheet receptacle on which a stack of sheets is placed, a vacuum casing located above the sheet receptacle at a location forwardly as viewed in the sheet feed direction and having an open bottom to define a vacuum chamber, a single movable bottom plate which is pivotally mounted on the vacuum casing on a horizontal axis at its rear end and including an air suction aperture or apertures adjacent its forward end and which is adapted to close the bottom opening of the vacuum chamber, and a sheet feed roller or rollers disposed within the vacuum chamber. A negative pressure is created within the vacuum chamber, and an uppermost sheet of the stack placed on the receptacle is held attracted to the underside of the bottom plate while the latter moves angularly to permit the feed roller or rollers to project through part of the openings to feed the sheet forwardly by friction.

In a sheet feeder of this kind, the movable bottom plate usually comprises a single plate member pivotally mounted on a horizontal axis disposed at the rear end of the casing and extending in a direction transverse to the sheet receptacle. When the negative pressure is not created within the vacuum chamber, the front end of the bottom plate bears against the uppermost sheet of the stack by weight. Consequently, the movable bottom plate assumes a varying angle of inclination relative to the uppermost sheet as the number of sheets contained in the stack or the height thereof changes. When the negative pressure is created, there occurs an airflow which is directed through the air suction openings formed in the bottom plate into the vacuum chamber, and the uppermost sheet is attracted and held attracted against the lower surface of the bottom plate to close the openings, thus maintaining the vacuum chamber substantially air-tight to permit the negative pressure within the chamber to be increased. When the negative pressure increases above a given value, the bottom plate moves angularly in the upward direction about the pivotal axis, whereby the uppermost sheet is separated from the next lower sheet. In order to assure a stabilized sheet separation and feeding operation, it is desirable that the configuration of the space defined by the lower surface of the bottom plate and the uppermost sheet remains unchanged throughout, namely, from the time the initial sheet is fed until the last sheet in the stack is fed from the sheet receptacle. However, with pneumatic sheet feeders of the conventional design, the bottom plate will assume an increasing angle of inclination relative to the uppermost sheet in the stack as the height thereof decreases, resulting in a change in the configuration of the space defined by the bottom plate and the uppermost sheet.

When the sheets are tightly stacked, or when there is no substantial air layer between adjacent sheets, more than one sheet may be attracted simultaneously, fouling the desired separation. If more than one sheet is fed in superposed relationship in a facsimile system, a jamming occurs, causing a failure of the system. Additionally, it will be appreciated that when an airflow occurs from the rear end of the feed rollers toward the air suction openings, the sheet separating air stream, that is, the flow of air around the front edge of the uppermost sheet into the space between the uppermost sheet and the next following sheet, is impeded, thus adversely influencing the sheet separation. In this manner, it will be appreciated that a close control of the sheet separation is required.

When the sheet feeder of the type described is used with the input section of a facsimile system, the feed rollers of the feeder deliver an original to be transmitted into the input section. Thereupon, the feeding operation of the original is continued by an original feeder of the facsimile system, which feeds it into the processing station. It will be understood that it is desirable, for purpose of reducing the noise and the power dissipation, that the feed operation by the sheet feeder be interrupted when the sheet or the original can be fed by the original feeder. In this instance, if the original is elongate in the feed direction, when the feed operation of the feeder is interrupted, the downwardly moving bottom plate may clasp the sheet being fed, thus increasing a load on the original feeder and causing an adverse influence upon the read operation. In worst cases, the original may be damaged.

In the sheet feeder disclosed in the above-mentioned U.S. Pat. No. 3,964,740, the feed rollers are carried by the vacuum casing and project downwardly through the air suction openings formed in the bottom plate when the latter moves angularly through a given stroke in the upward direction. This disadvantageously prevents a stabilized sheet separation in that the front end of the uppermost sheet is kept from upward movement by the front end of the movable bottom plate.

To avoid this difficulty, the present applicant has proposed a sheet feeder in U.S. application Ser. No. 825,389, now abandoned, in which the feed rollers are mounted on the bottom plate so as to press against the sheets on the receptacle. However, in this sheet feeder, the rotation is transmitted to the feed rollers by friction with a drive shaft which is arranged to be moved into sliding contact with the feed rollers when the feed rollers are displaced upwardly through a given stroke together with the bottom plate. This requires a biasing pressure of a relatively large magnitude between the feed rollers and the drive shaft in order to assure the stabilized rotation of the feed rollers. Consequently, a large proportion of the fan capacity which produces the negative pressure to lift the bottom plate upwardly must be reserved for use as the bias pressure. Hence, the fan becomes less effective in lifting the bottom plate, with a reduced holding effect of the feed roller. When the sheet holding effect of the feed roller is reduced, the uppermost sheet will be bent under the action of the negative pressure beyond a boundary defined by the feed rollers, and the bottom plate may begin to move upwardly before the uppermost sheet is held attracted to the lower surface of the bottom plate, thus resulting in an unstabilized sheet separation. In addition, when the feed rollers are mounted on the bottom plate, the overall weight of the latter increases, presenting a problem that an increased negative pressure is required to lift it upwardly.

SUMMARY OF THE INVENTION

It is an object of the invention to provide a pneumatic sheet feeder which overcomes the difficulties of the conventional pneumatic sheet feeders by maintaining a space of uniform configuration defined by a movable bottom plate and an uppermost sheet irrespective of a change in the height of a stack of sheets placed on a sheet receptacle, thus achieving a uniform feed condition to assure a stabilized sheet separation and feeding operation.

It is another object of the invention to provide an improved pneumatic sheet feeder capable of assuring a stabilized sheet separation even if the sheets are tightly stacked on the sheet receptacle.

It is a further object of the invention to provide an improved pneumatic sheet feeder which may have its operation interrupted in the course of feeding a sheet from the original receptacle without clasping the sheet being fed to increase a mechanical load or damaging an original.

It is another object of the invention to provide an improved pneumatic sheet feeder which blocks an airflow directed from rearwardly of the feed rollers toward the air suction openings, thereby assuring a stabilized sheet separation.

It is still another object of the invention to provide an improved pneumatic sheet feeder which achieves a reliable sheet separation and feeding operation.

It is a still further object of the invention to provide an improved pneumatic sheet feeder of the type having feed rollers mounted on a movable bottom plate in which the transmission of rotating force to the feed rollers is assured while simultaneously achieving a stabilized sheet separation and feeding operation.

The above and other objects and features of the invention will become apparent from the following detailed description of embodiments thereof with reference to the drawings.

DETAILED DESCRIPTION OF PREFERRED EMBODIMENTS

Figure 1:
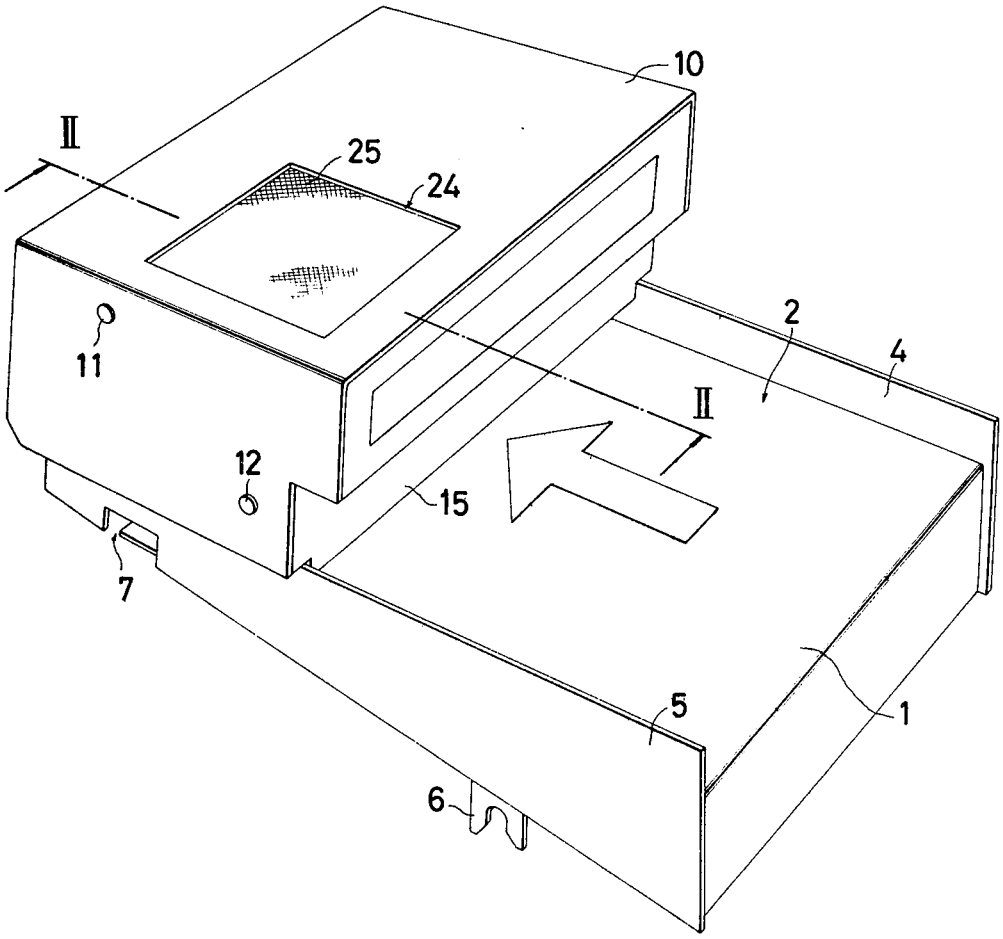
FIG. 1 is a schematic perspective view of one embodiment of the sheet feeder according to the invention.
Figure 2:
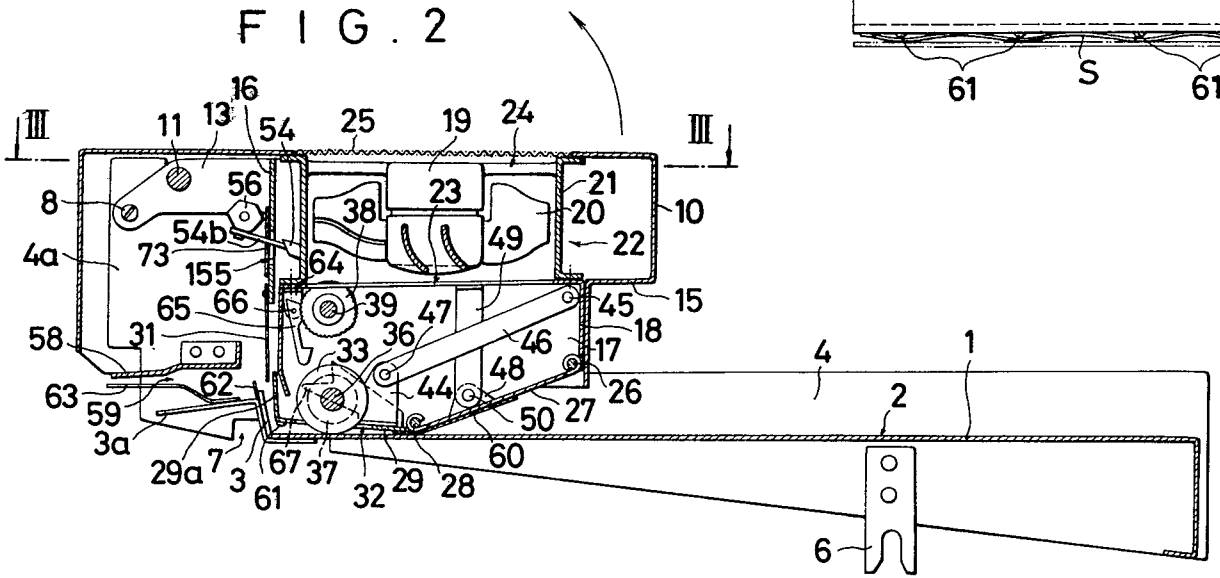
FIG. 2 is a cross section taken along the line II—II shown in FIG. 1.

Referring to FIG. 1, there is shown a sheet feeder incorporating various features of the invention. As shown, the sheet feeder includes a sheet receptacle 1 having a generally flat upper surface 2 and on which sheets to be fed are placed. As shown in FIG. 2, the receptacle 1 is provided with a front barrier 3 which is slightly inclined from the vertical in order to reduce the resistance experienced during the sheet separation. The receptacle is also provided with vertical side plates 4, 5. Each side plate 4, 5 is provided with a fixture 6 which permits a detachable mounting of the entire sheet feeder shown in FIG. 1 on the input section of a facsimile system, for example, and is also formed with a notch 7 which admits an airflow to enhance the separation effect.

At its front end, each side plate has an upstanding bracket *4a*, *5a* (see FIG. 3) having respective support pins 8 or 9 mounted thereon and which are used to support a feed head casing 10 to be described later. The casing 10 is box-shaped and has an open bottom. A pair of fasteners 11, 12 connect a pair of inner plates 13, 14 to the side walls of the casing 10, and forward portions of the inner plates are pivotally mounted on the support pins 8, 9 so that the casing is angularly movable between its operative position shown in FIG. 2, and its inoperative position in which it is moved away from the upper surface of the receptacle 1. The casing 10 is rearwardly provided with an overhang 15 which may be engaged by hand to swing casing 10 in the direction of the arrow. A vertical partition 16 is provided between the inner side plates 13, 14 at a position corresponding to the barrier 3 when the casing 10 is in its operative position, dividing the inner space thereof into a forward chamber and a rear chamber. Fixedly mounted in the rear chamber is a vacuum casing 18 which defines a vacuum chamber 17 having an open bottom. An air suction device 22, including a casing 21 which contains an an electric motor 19 and a axial flow fan 20 driven thereby, is disposed in the top of the casing 18. The fan 20 draws air into the vacuum chamber 17 through a vent hole 23 formed in the top wall of the casing 18, and discharges the air externally through an exhaust hole 24 formed in the top wall of the casing 10. It will be seen that the exhaust hole 24 is covered with an air permeable member 25 such as metal meshwork.

The vacuum casing 18 carries a first pivot shaft 26 which extends virtually horizontally across the receptacle 1 along the rear edge of its bottom opening, and the rear end of a first movable bottom plate 27 is pivotally mounted on the shaft 26, whereby it is angularly movable about the axis of shaft 26. The bottom plate 27 has a length which is sufficient to close the rear half of the bottom opening. At its front end, the bottom plate 27 carries a second pivot shaft 28 which extends horizontally across the receptacle 1, and the rear end of second movable bottom plate 29 is pivotally mounted on the shaft 28, whereby it is angularly movable about the axis of shaft 28. The front end of the second bottom plate 29 extends to the forward edge of the bottom opening. In this manner, the bottom opening of the vacuum casing 18 can be closed by the pair of lengthwise staggered movable bottom plates pivotally connected together by the shaft 28.

Figure 4:
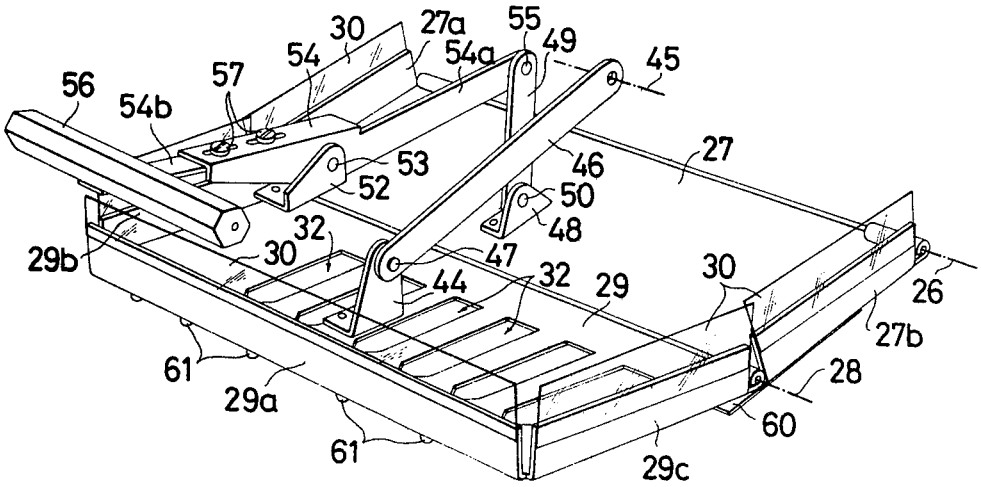
FIG. 4 is a perspective view of a movable bottom plate structure.
Figure 5:
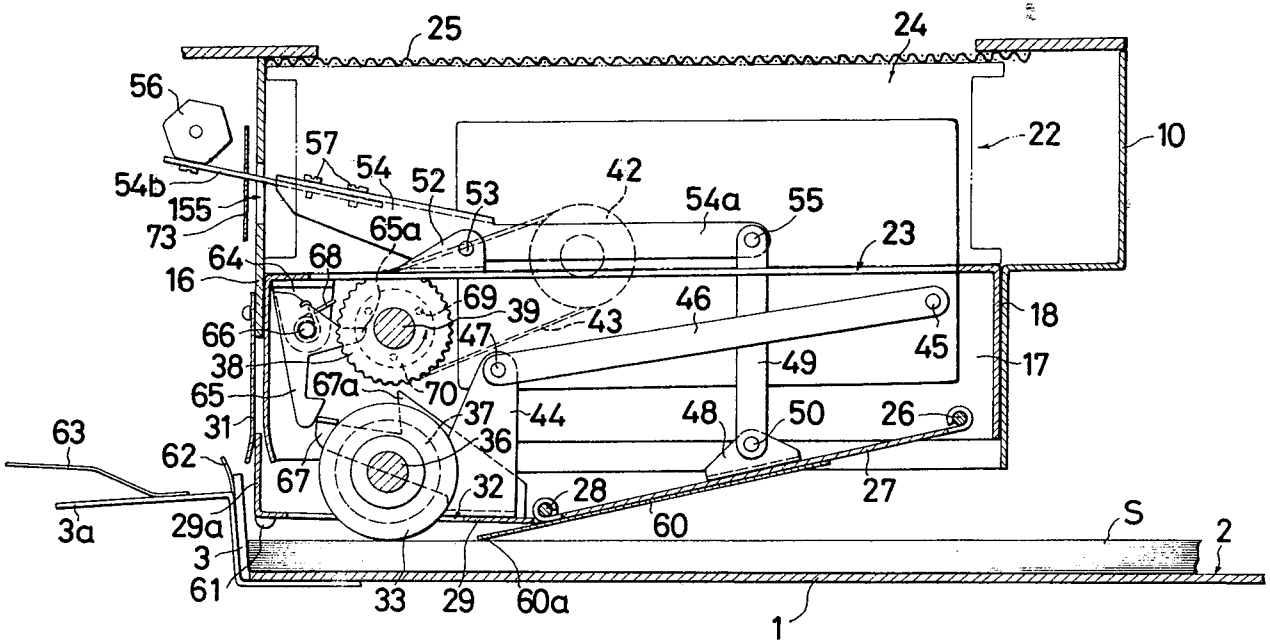
FIGS. 5 and 6 are longitudinal sections illustrating two different phases of operation of the sheet feeder.

Referring to FIG. 4, in the embodiment shown, the lateral edges of the first movable bottom plate 27 as well as the front end and the lateral edges of the second movable bottom plate 29 are provided with folded, upstanding flanges 27*a*, 27*b* and 29*a*, 29*b*, 29*c*, respectively, which are disposed in surrounding relationship with both of the side walls and the front wall of the vacuum casing 18. The upstanding flanges are provided with flexible thin sheets 30 such as Mylar film to improve the air tightness between the folded pieces and the vacuum casing. As shown in FIGS. 2 and 5, the partition 16 is also provided with a flexible thin sheet 31 which depends downwardly therefrom outside the vertical folded flange 29*a* at the front end of the second movable bottom plate 29, thus improving the air tightness between the folded flange and the vacuum casing 18. Adjacent the front end, the bottom surface of the second movable bottom plate 29 is provided with a plurality of semi-spherical projections 61 which are spaced apart in a direction transverse to the sheet feed direction. Preferably, these projections 61 are located in a manner to correspond to the location of the feed rollers 33.

Figure 3:
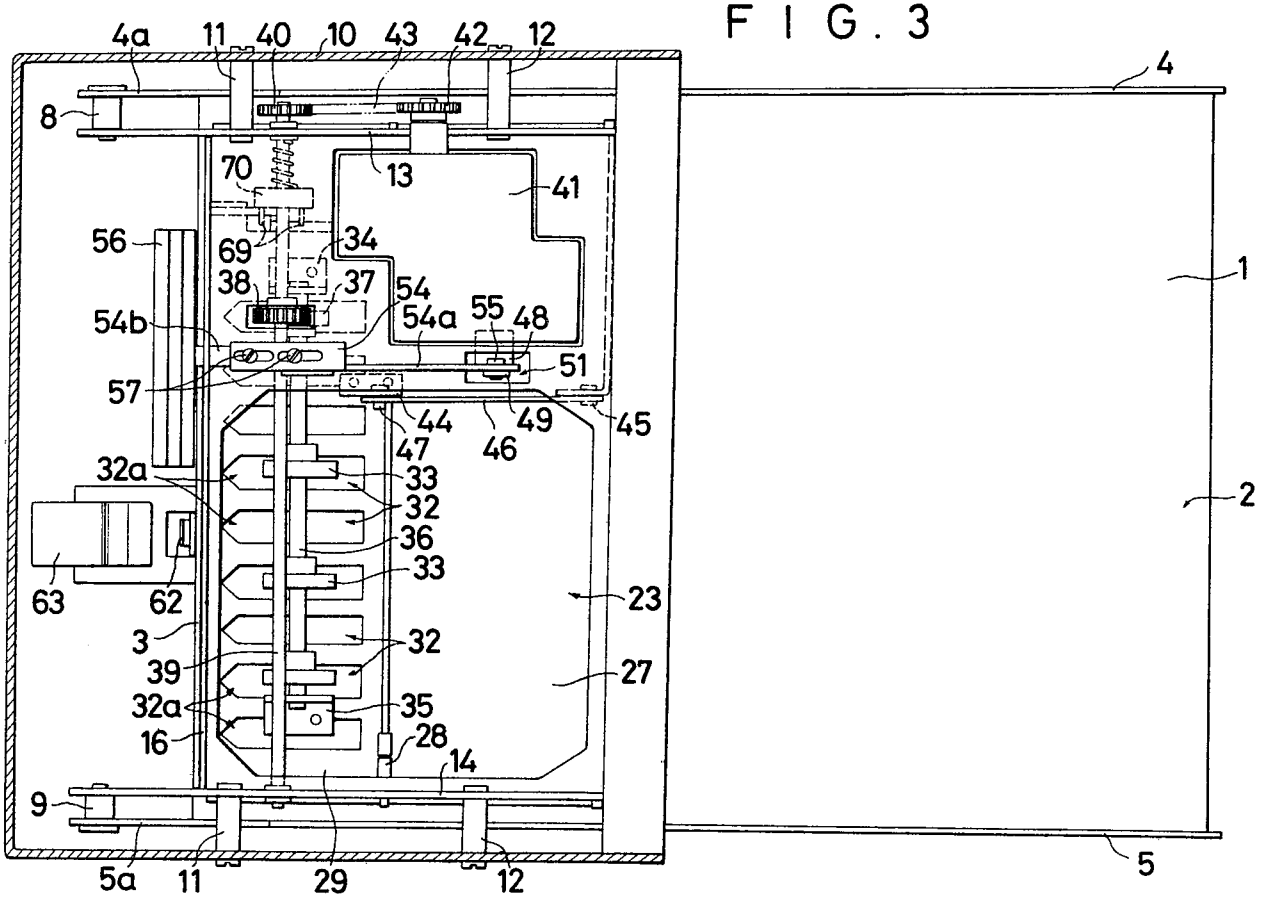
FIG. 3 is a cross section taken along the line III—III shown in FIG. 2.

As shown in FIGS. 3 and 4, the second movable bottom plate 29 is formed with a plurality of air suction openings 32 which are elongate along the direction of sheet feed and which are spaced apart across the width thereof. In the embodiment shown, plural feed rollers 33, formed of rubber or similar material, are disposed in alternate openings 32. These feed rollers 33 are fixedly carried by a roller support shaft 36 which is rotatably supported by a pair of bearing brackets 34, 35 mounted on the upper surface of the second bottom plate 29. The peripheries of these rollers partly project downwardly through the openings 32 so as to be placed in sliding contact with the upper surface 2 of the receptacle 1. Consequently, when the bottom plates 27, 29 are in their lower positions which they assume by weight, the front end of the bottom plate 27 and the rear end of the bottom plate 29 bear against the receptacle 1 while the bottom plate 29 is disposed at a small angle of inclination relative to the upper surface 2. It is preferred, for the purpose of assuring a sheet separation, that the feed rollers 33 be offset toward the rear end of the openings 32 or spaced from the front barrier 3, and the openings 32 are preferably tapered toward their front end 32*a*, as shown.

As clearly indicated in FIG. 3, the shaft 36 carries a gear 37, which is adapted to mesh with a gear 38 disposed within the vacuum chamber 17 when the second bottom plate 29 moves upwardly through a given stroke. Preferably the gears 37, 38 have triangular teeth of a small module to permit a smooth engagement therebetween since they engage and disengage from each other as the second bottom plate 29 moves vertically. The gear 38 is fixedly mounted on a shaft 39 which is rotatably supported between the inner side plates 13, 14. At its one end, the shaft 39 carries a timing belt pulley 40, which is drivingly connected with a timing belt pulley 42 associated with a feed roller drive motor 41 located within the casing 10 through a timing belt 43. It is to be noted that the gear 38 is driven counterclockwise as viewed in FIG. 2.

The second bottom plate is moved vertically by an elevator mechanism. Specifically, the bottom plate 29 centrally carries a bracket 44. A link 46 has its one end pivotally mounted on a third pivot shaft 45 located in the rear upward portion of the casing 18 and has its other end pivotally mounted on a fourth pivot shaft 47 carried by the bracket 44. The link 46 cooperates with the first bottom plate 27 to form a parallelogram linkage, whereby the second bottom plate 29 can be translated bodily substantially in the vertical direction relative to the upper surface of the receptacle 1. In this embodiment, the first bottom plate 27 centrally carries a bracket 48 carrying a pivot shaft 50 on which one end of a link 49 is mounted. The other end of the link 49 extends through an opening 51 (see FIG. 3) formed in the top wall of the casing 18 to project upwardly for pivotal connection at 55 with one end of a lever element 54 which is pivotally mounted at 53 on a bracket 52 which is in turn secured to the top surface of the casing 18. The other end of the lever element 54 extends through an opening 155 (see FIG. 5) formed in the partition 16 into the forward chamber defined within the head casing 10, and its free end carries a counterweight 56. The counterweight 56 acts through lever element 54 and link 49 to bias the first bottom plate 27 upward, thereby allowing the second bottom plate 29 which carries feed rollers 33, as well as the first bottom plate 27 to be raised with a relatively small force. In the example shown, the lever element 54 comprises a pair of elements 54*a*, 54*b* which are connected in a telescopic manner and secured together by screws 57 to permit an adjustment of the overall length. A thin metal sheet 73 extending through the element 54*b* closes the opening 155 in order to prevent the negative pressure created within the vacuum chamber 17 from being disturbed.

Figure 16:
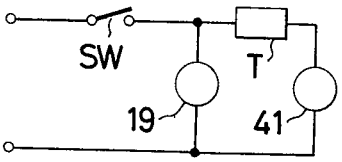
FIG. 16 is a schematic circuit diagram of an electrical circuit used in the sheet feeder of the invention.

As shown in FIG. 16, the fan drive motor 19 associated with the air suction device 22 is directly connected with a start switch SW while the feed roller drive motor 41 is connected with the start switch SW through a delay circuit T. The delay circuit T may comprise a logic circuit of known form, including a CR or NAND circuit or may comprise a time limit relay, and has a time delay on the order of four to eight seconds.

Figure 20:
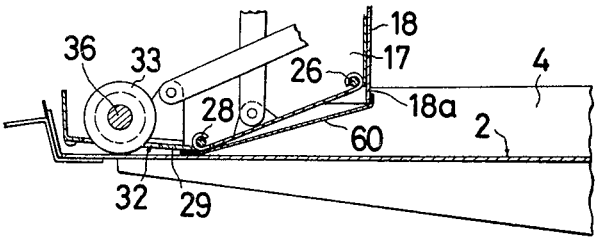
FIGS. 20 and 21 are cross sections of other embodiments of the invention.

A flexible thin sheet 60 has its one end adhesively secured to the lower surface of the first bottom plate 27, and extends beyond the second pivot shaft 28 to a position short of feed rollers 33, with its free end 60*a* engaging the upper surface of a sheet on the receptacle 1 (see FIG. 5). The sheet 60 may have its one end secured to the rear wall 18*a* of the vacuum casing 18 as shown in FIG. 20.

It will be seen in FIG. 2 that the front barrier 3 is formed with a guide plate 3*a* which is slightly offset from the upper end thereof and inclined toward the sheet feed direction. The guide plate 3*a* defines a sheet delivery passage 59 together with an upper guide plate 58 which is mounted to extend across the side plates 4, 5 and located above the guide plate 3*a*. A rubber piece 62 has its one end secured to the barrier 3 and has a freely flexible upper end which projects above the guide plate 3*a* and into the passage 59. Another rubber piece 63 has its one end also secured to the guide plate 3*a* and extends forwardly within the passage 59, leaving a free end.

Figure 11:
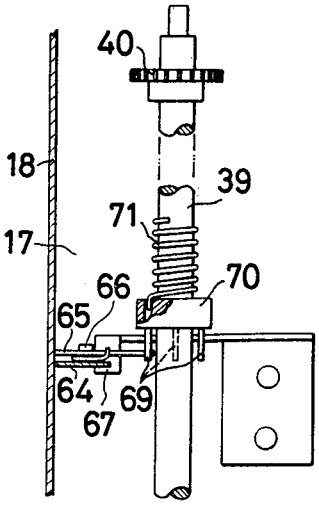
FIG. 11 is a plan view of the locking mechanism.

As shown in FIG. 5, a bracket 64 is provided within the vacuum chamber 17, and a locking claw 65 is pivotally mounted on a pin 66 secured to the bracket. An engaging element 67 engageable with the claw 65 is mounted on the upper surface of the second bottom plate 29. The claw 65 is biased counterclockwise, as viewed in this Figure, by a torsion spring 68 and thus is normally located in a position engageable with the element 67. A ring 70 having unlock pins 69 is rotatably mounted on the shaft 39, and is connected with one end of a coiled spring 71 (see FIG. 11) which is disposed on the shaft 39. The spring 71 is normally coiled relatively tightly around the shaft 39, but is uncoiled by the forward or counterclockwise rotation of the shaft 39 when the ring 70 is prevented from rotating relative to the shaft 39, to thereby permit a free rotation of the shaft 39 relative to ring 70, thus forming so-called one-way clutch. The engaging element 67 includes a stop wall 67*a* which bears against an unlock pin 69 on the ring 70 to prevent a rotation of the ring in the up-position of the second bottom plate 29, while the locking claw 65 includes an unlock pawl 65*a* which bears against an unlock pin 69. When the unlock pawl 65*a* is driven by an unlock pin 69, the locking claw 65 is moved into a position in which it is disengaged from the engaging element 67. The function of the locking mechanism will be described later.

Figure 7:
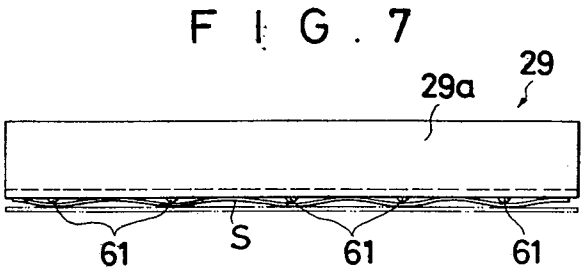
FIG. 7 is a front view of the movable bottom plate assembled into the apparatus of the invention.
Figure 6:
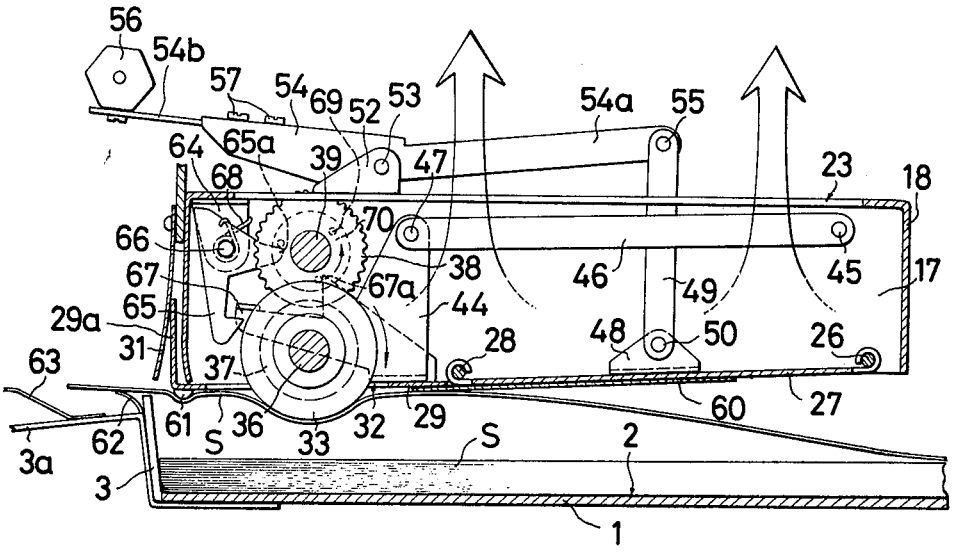

The operation of the sheet feeder thus constructed will now be described with reference to FIGS. 5 and 6. Sheets S to be fed are placed in a stack in the receptacle 1 with their leading ends aligned by abutment against the front barrier 3, as shown in FIG. 5. The sheets can be located in place by raising the head casing 10. Where the number of sheets is small, they can be inserted in place without raising the casing. When the sheets are positioned as mentioned above, the feed rollers 33 bear against the upper surface of the uppermost sheet in the stack and are gently pressed thereagainst by their own weight and that of the second bottom plate 29. The pressure applied is determined by the balance between the weight of rollers 33, their support and second bottom plate 29 on one hand and the weight of the counterweight 56 on the other. It is to be noted that the magnitude of the pressure is critical in achieving the sheet separation, that is, attracting only the uppermost one of the sheets in the stack. When the start switch SW is closed under this condition, the motor 19 of the air suction device 22 is set in motion, whereby the axial flow fan 20 begins to rotate. The feed roller drive motor 14 is not yet driven as a result of the delay circuit T (see FIG. 16). As the fan 20 rotates, the air is drawn into the vacuum chamber 17 through the air suction openings 32, whereby a suction is applied to a portion of the uppermost sheet S in the stack which is located forwardly of the point of contact between the rollers 33 and the sheet. It will be appreciated that, if the air is withdrawn through a portion of the openings 32 located rearwardly of the feed rollers 33, the airflow which serves the sheet separation, namely, the flow of air entering the space created between the uppermost sheet and the next following sheet around the leading edge of the uppermost sheet, will be reduced, and the air pressure then prevailing above the uppermost sheet acts to hold back the sheet to prevent an upward movement of movable bottom plate 27, 29, thus exerting adverse influences upon the sheet separation. However, these influences are prevented by the provision of the flexible sheet 60. The sheet 60 also prevents the admission of the air through the junction between the first and second bottom plates 27, 29. As the fan 20 increases its angular velocity, the uppermost sheet begins to be drawn up, gradually blocking the openings 32 until it is flat against the lower surface of the second bottom plate 29 to thereby completely block the openings 32. The front end of the sheet will be corrugated by abutment against the projections 61 as shown in FIG. 7. It will be understood that, if a second sheet is drawn or attracted together with the uppermost sheet, the corrugations are effective to create layers of air between the two sheets in the valley regions inasmuch as the lower sheet is not corrugated by virtue of the rigidity of of the paper material. As a consequence, the lower sheet will fall down onto the stack or the receptacle by its own weight, thus preventing a double sheet feeding.

When the openings 32 are blocked by the sheet, the vacuum chamber 17 is substantially enclosed to permit the negative pressure therein to be increased, and such negative pressure is effective to raise the second bottom plate 29. As a result of the parallelogram linkage formed by the first bottom plate 27 and link 46, the second bottom plate 29 moves while maintaining a substantially horizontal position. When the bottom plate 29 moves through a given stroke upwardly while maintaining the sheet S attracted to its bottom surface, the gear 37 moves into meshing engagement with the gear 38. After several seconds have passed, the motor 41 is energized to initiate the rotation of the gear 38, which is transmitted to the gear 37. As a consequence, the feed rollers 33 are driven for clockwise rotation, feeding the sheet which is held attracted forwardly, namely, to the left as viewed in the drawings, by friction. Since there is a time interval on the order of several seconds after the movable bottom plate is raised until the feeding operation of the sheet is initiated, there is sufficient time for any sheet or sheets other than the uppermost one which may have been drawn upwardly together with the uppermost one to fall down by weight, thus effectively preventing a plurality of sheets from being simultaneously fed. The double sheet feeding is also prevented by the provision of rubber pieces 62 and 63 which the sheets have to ride past in sliding relationship. Specifically, if two sheets are fed in superimposition, the lower sheet will be retarded by sliding friction with the rubber pieces 62, 63, and hence cannot be simultaneously fed with the upper sheet.

Figure 8:
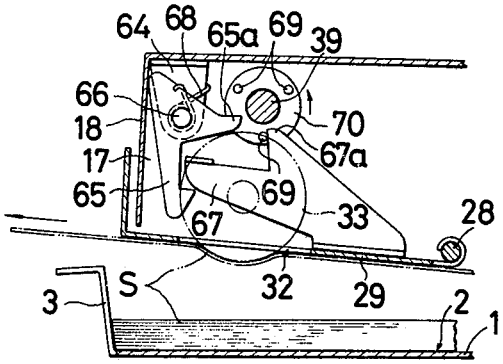
FIGS. 8 to 10 are cross sections of an exemplary locking mechanism.

As shown in FIG. 8, when the shaft 39 is driven for rotation in the up position of the bottom plate 29, the stop pawl 67*a* engages the unlock pin 69 on the ring 70, preventing the rotation of the ring. However, this does not interfere with the rotation of the shaft 39 by virtue of the functioning of the coiled spring 71.

Figure 9:
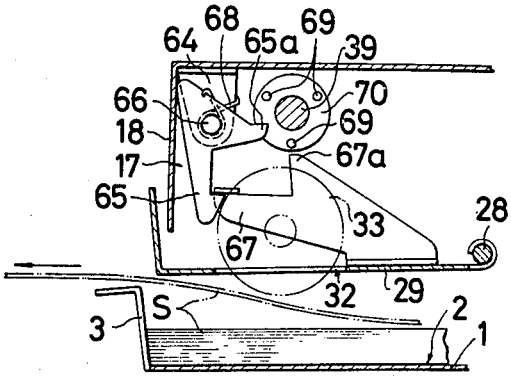
Figure 10:
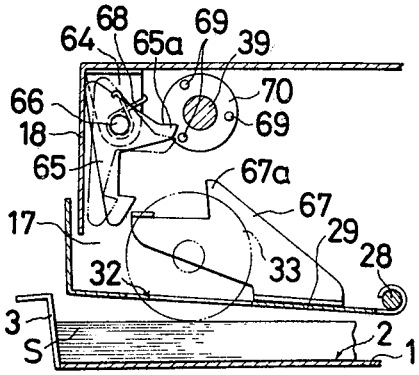

The sheet delivered by the sheet feeder is fed into a facsimile system by sheet feed means thereof, not shown, and hence the feeding operation by the feed rollers 33 may be interrupted. Thus, the motors 19, 41 are deenergized at this time to stop the rotation of the feed rollers 33. Thereupon the negative pressure within the vacuum chamber 17 collapses and the second bottom plate 29 moves down by weight. However, in the course of the downward movement, the element 67 engages the locking claw 65 as shown in FIG. 9 to maintain the bottom plate 29 in an intermediate position. This maintains an opening of given magnitude between the front barrier 3 and the front edge 29*a* of the second bottom plate 29, allowing a continued feeding of the sheet without imposing a load from the bottom plate thereon. Since the motor 41 is now deenergized, the shaft 39 ceases to rotate. As a consequence, if the stop pawl 67*a* no longer prevents the rotation of the ring 70, the locking claw 65 cannot be moved by the unlock pin 69 to its unlock position. When a read complete signal is fed from the reader of the facsimile system, for example, to initiate the feeding operation of a next following sheet, the shaft 39 is again set in rotation simultaneously, whereby the locking claw 65 is moved by the unlock pin 69 to its unlock position shown in phantom line in FIG. 10 to thereby move the element 67 away from the locking claw 65. Then, the second bottom plate 29 falls down into abutment against the next sheet by its own weight, initiating the sheet separation. The stroke through which the bottom plate 29 moves down at this time will be increased by an amount corresponding to the thickness of one sheet which has been fed. However, because the downward movement takes place by its translational movement achieved with the function of the parallelogram linkage, there occurs no change in the angle of inclination of the second bottom plate 29 relative to the upper surface of the sheet, thus maintaining the initial favorable condition independently of the number of sheets on the receptacle 1. This assures a stabilized sheet separation and feeding operation.

Figure 12:
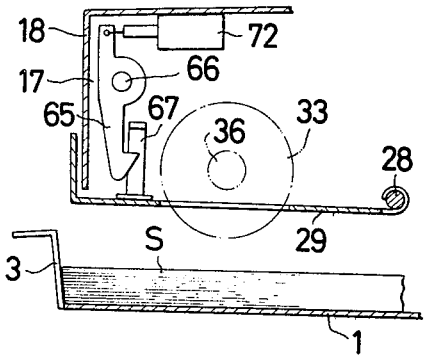
FIG. 12 is a cross section of another example of the locking mechanism.

FIG. 12 shows another form of locking element. It is to be noted that corresponding parts are designated by like numerals as used in FIGS. 8 to 11. In this instance, the locking claw 65 is adapted to be operated by a solenoid unit 72. The timing at which the second bottom plate 29 is locked or unlocked can be freely chosen by controlling the energization of the solenoid unit 72.

Figure 17:
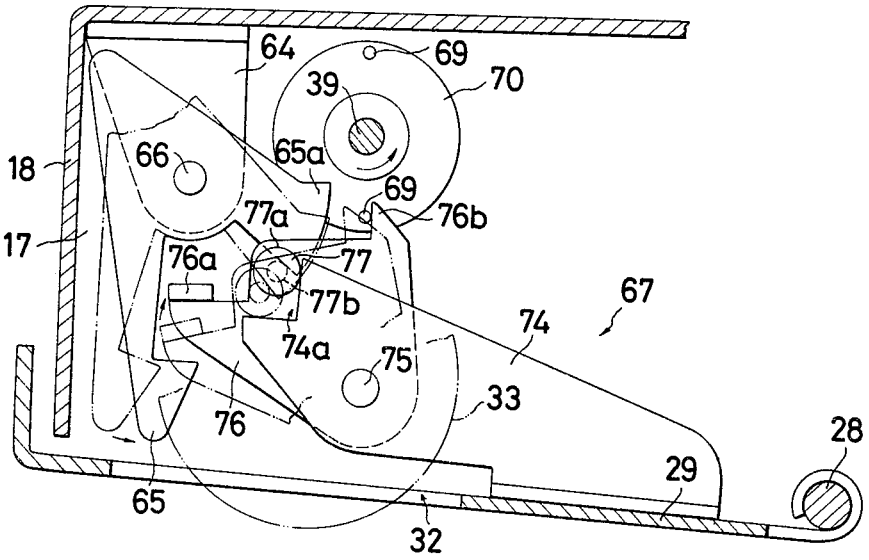
FIGS. 17 and 19 are cross sections illustrating other forms of locking mechanism.

FIG. 17 shows a further form of locking mechanism which maintains the bottom plate 29 in its up position. It is to be noted that corresponding parts are designated by like numerals as used in FIGS. 1 to 12. In this instance, the locking claw 65 is rotatably mounted on the shaft 66 in a freely detentable manner. Specifically, the claw 65 can be stopped at any desired angular position relative to the bracket 64. The element 67 comprises an anchorage 74 secured to the upper surface of the bottom plate 29 and carrying a pin 75, and a movable member 76 is pivotally mounted on the pin 75. The movable member 76 includes a pawl **76*a* adapted to engage the locking claw 65, a stop pawl 76*b* engageable with an unlock pin 69 on the ring 70, and a stepped pin 77. The movable member 76 is angularly movable about the pin 75 through an angle of 10° when the large diameter portion 77*a* of the stepped pin 77 bears against horizontal and vertical end faces of an L-shaped notch 74*a* formed in the free end of the anchorage 74, and normally assumes a position which is indicated in phantom line, by its own weight. The stepped pin 77 also has a small diameter portion 77*b* which can abut against the rear end face of the unlock pawl 65*a* which is integral with the locking claw 65, and is effective to move the locking claw 65 from its unlocked position, shown in phantom line, to its locked position, shown in solid line, as the movable member 76** angularly moves from its phantom line to its solid line position.

With this arrangement, when the bottom plate 29 assumes its up position owing to the negative pressure created within the vacuum chamber 17, an unlock pin 69 bears against the stop pawl **76*b* to raise the movable member 76 to a position shown in solid line, and consequently the locking claw 65 is moved to its locked position shown in solid line, by the small diameter portion 77*b* of the stepped pin 77. Upon completion of the feeding operation by the sheet feeder, the shaft 39 ceases to rotate and the negative pressure within the vacuum chamber collapses, whereby the bottom plate 29 has its pawl 76*a* engaged with the locking claw 65 to be maintained in its intermediate position. Subsequently when the next sheet separation and feeding operation is initiated, an unlock pawl 65*a* is driven by the unlock pin 69 as the shaft 39 begins to rotate, whereby the locking claw 65 rotates clockwise about the shaft 66 to its unlock position, thus disengaging the pawl 76*a* from the locking claw 65 to permit the bottom plate 29 to move down by weight. Hence, during the sheet separation process, the unlock pawl 65*a* cannot be engaged by an unlock pin 69 on the rotating ring 70, preventing the generation of percussion sound produced upon the abutment between a pawl 65*a* and the pin 69. The formation of the element 67 in two parts 74, 76 avoids an interference of a pin 69 with the upward movement of the bottom plate 29. Specifically, the difficulty that the pawl 67*a* may abut against a pin 69 as the bottom plate 29 is raised (see FIG. 9) is avoided by dividing the element 67 into two parts, thus ensuring the upward movement of the bottom plate 29**.

Figure 18:
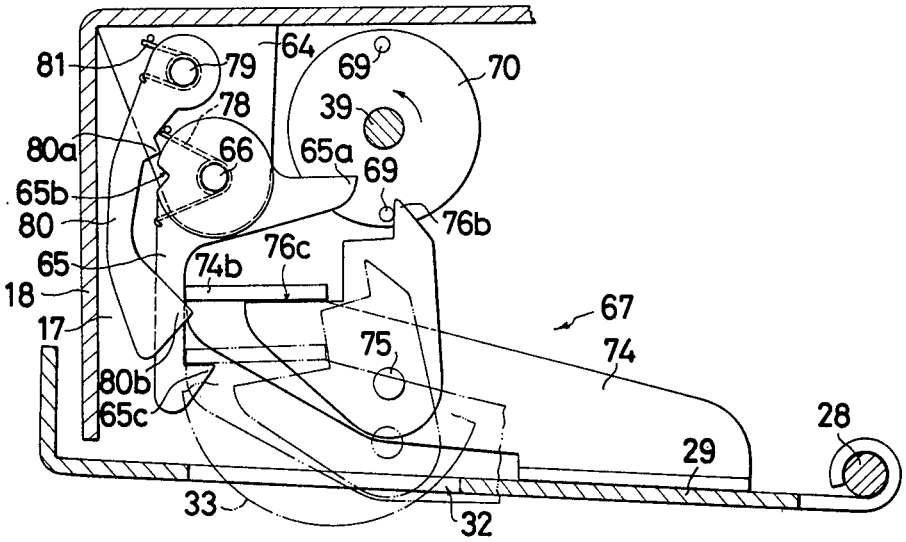
Figure 19:
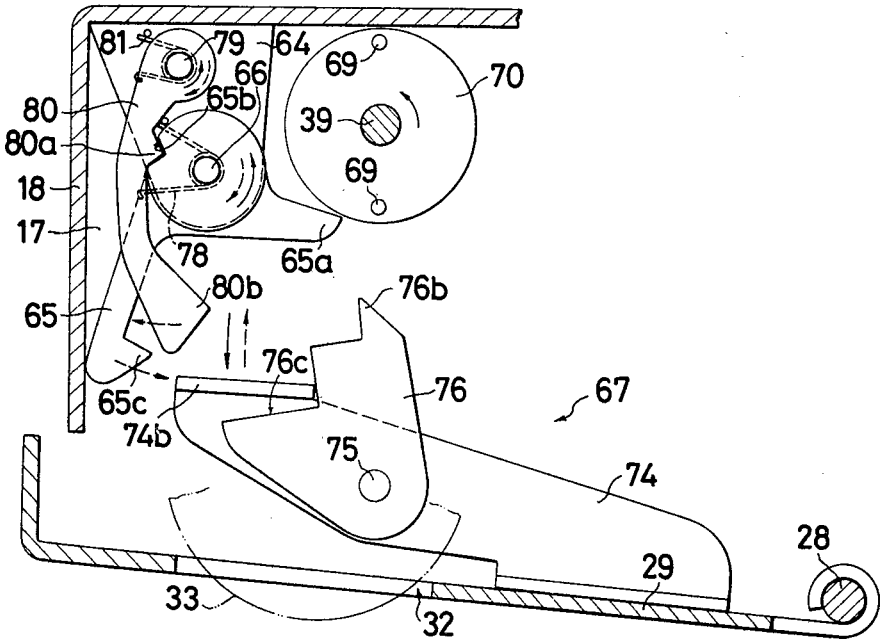

FIGS. 18 and 19 show still another from of locking mechanism. Again it is to be noted that corresponding parts are designated by numerals as used in FIGS. 1 to 12. In this instance, the locking claw 65, having its integral unlock pawl **65*a*, is biased counterclockwise, as viewed in these Figures, as in the initially mentioned embodiment. However, the claw 65 is formed with a V-groove 65*b* in its hub. The anchorage 74 of the element 67 carries pin 75 on which the movable member 76, formed with stop pawl 76*b*, is pivotally mounted. The bracket 64 carries a pin 79 on which a holding lever 80 is pivotally mounted. The holding lever 80 is biased counterclockwise by a torsion spring 81, and is formed with a V-shaped end 80*a* which is adapted to engage the V-groove 65*b* to maintain the locking claw 65** in its unlock position whenever the latter has moved to such position.

When the movable bottom plate 29 is raised to its up position by the negative pressure created within the vacuum chamber 17 as shown in FIG. 18, an unlock pin 69 bears against the stop pawl **76*b* and the V-shaped end 80*a* is disengaged from the groove 65*b*, whereby the locking claw 65 is in its locked position. When the sheet feeding operation by the sheet feeder is completed under this condition, the negative pressure collapses and the shaft 39 ceases to rotate. The bottom plate 29 is maintained in its intermediate position shown in phantom line in which the pawl 74*b* of the anchorage 74 engages portion 65*c* of the locking claw 65. A rocking motion of the movable member 76 engaged by an unlock pin 69 is prevented as a result of the engagement between its one side 76*c* with the pawl 74*b*. When the next sheet separation and feeding operation is initiated and the shaft 39 begins to rotate, the unlock pawl 65*a* is driven by an unlock pin 69 as shown in FIG. 19, thus rotating the locking claw 65 clockwise about the shaft 66. As a consequence, the element 67 is disengaged from this claw, allowing the bottom plate 29 to move down by weight. At this time, the claw 65 is maintained in its unlock position as a result of the engagement between the V-groove 65*b* and the end 80*a* of the holding lever 80. The locking claw is maintained in this position until the bottom plate 29 is raised to a position such that the element 67 displaces the end 80*b* of the holding lever 80. In this manner, the abutment between the unlock pawl 65*a* and an unlock pin 69** during the sheet separation is again avoided.

In the forgoing description, it has been stated that the unlock pin 69 abuts against the stop pawl **76*b* and the V-shaped protrusion 80*a* is disengaged from the V-groove 65*b* (see FIG. 18) when the bottom plate 29 is raised as a result of the negative pressure within the vacuum chamber. However, depending on the positional relationship between the unlock pin 69 and the bottom plate 29 as its is raised, the end 80*a* may engage the groove 65*b* as shown in FIG. 19. Specifically, when the bottom plate 29 is raised under the condition shown in FIG. 19, the element 67 intially drives the end 80***b* of the holding lever 80 to disengage the end 80*a* from the groove 65*b* as shown in FIG. 18. However, as an unlock pin 69 rotates the pawl 65*a*, they are again engaged with each other as shown in FIG. 19, rocking the locking claw 65 to its unlock position. When the negative pressure created within the vacuum chamber is released and the bottom plate 29 moves down, the pawl 74*b* of the element 67 displaces the end 80*b* now from above, disengaging the end 80*a* from the groove 65*b* to rock the locking claw 65 to its locked position as shown in FIG. 18.

Figure 13:
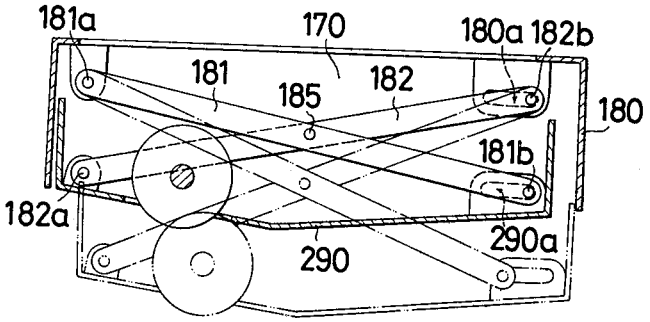
FIGS. 13 and 14 are front views, partly in cross section, of different forms of the mechanism which performs a parallel movement of a single movable bottom plate.
Figure 14:
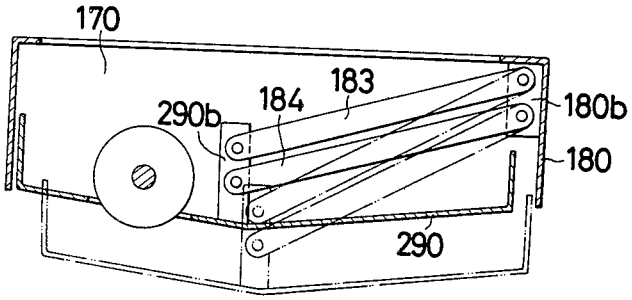

In the above description, the movable bottom plate against which a sheet is held attracted comprises a pair of bottom plate portions. However, a single movable bottom plate may be used to achieve the intended object provided it can be maintained at a given angle of inclination with respect to the uppermost sheet irrespective of the height of the sheet stack. Referring to FIGS. 13 and 14, there is shown a vacuum casing 180 which defines a vacuum chamber 170 having a bottom opening which is closed by a single movable bottom plate 290. The bottom plate 290 is connected with the casing 180 through a linkage including a plurality of links. Referring to FIG. 13, a link 181 has its one end 181*a* pivotally connected with the casing 180 and its other end 181*b* loosely fitted into an elongate slot 290*a* formed in the rear end of the bottom plate 290. Another link 182 has its one end 182*a* pivotally connected with the front end of the bottom plate 290 and its other end 182*b* loosely fitted into an elongate slot 180*a* formed in the rear end of the casing 180. Both links are pivotally interconnected by a pin 185. FIG. 14 shows a pair of parallel links 183, 184 which have their opposite ends pivotally connected with the vacuum casing 180 and the bottom plate 290, respectively, and a four-link linkage is formed by links 183, 184, bracket 290*b* and bracket 180*b* of the casing.

Figure 15:
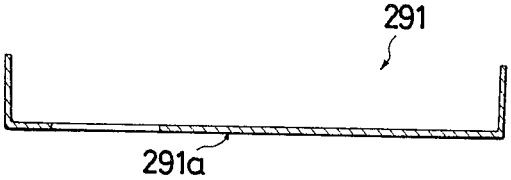
FIG. 15 is a cross section of another form of movable bottom plate.

The linkage constitutes an elevator mechanism for moving the bottom plate 290 between a down position shown in phantom line and an up position shown in solid line in accordance with the presence or absence of the negative pressure created within the vacuum chamber 170, while maintaining a horizontal position. As a consequence, the space defined by the bottom plate and the uppermost sheet does not change in configuration if the height of the stack of sheets placed on a sheet receptacle, which is located below the bottom plate, changes. In other words, it is assured that the bottom plate is oriented at a constant angle of inclination relative to the uppermost sheet in the stack irrespective of the number of sheets therein. The botton plate shown in FIGS. 13 and 14 is slanted in a direction perpendicular to the direction of sheet advance, but it may be formed with a flat sheet holding surface as shown at 291*a* of a movable bottom plate 291 (see FIG. 15). In this instance, however, it is preferred that it is mounted on the vacuum casing with a slight inclination relative to the sheet receptacle (refer to the second bottom plate 29 shown in FIG. 5).

Figure 21:
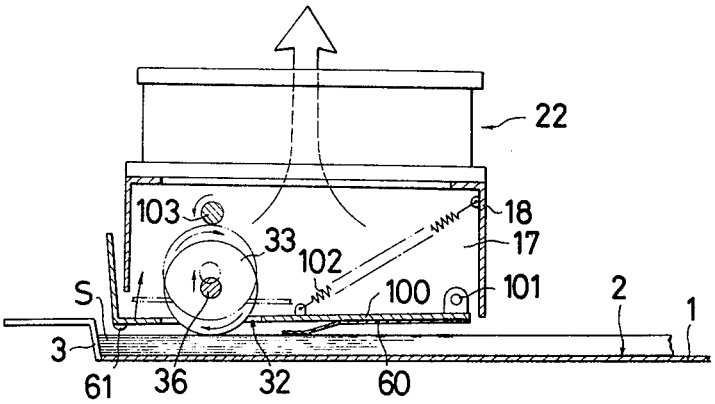

FIG. 21 shows another embodiment of the pneumatic sheet feeder according to the invention. It is to be understood that corresponding parts are designated by like numerals as used in FIGS. 1 to 20. The vacuum chamber 17 is closed by a single movable bottom plate generally shown by numeral 100. The bottom plate 100 is pivotally mounted on a pin 101 at the rear end of the chamber 17, and is biased to move upward by a spring 102 extending between the vacuum casing and the bottom plate. Feed rollers 33 are driven frictionally by a drive shaft 103 against which they are brought into sliding contact as the bottom plate 100 is raised to a given level. In this embodiment, the resilience of spring 102 reduces the effective weight of the movable bottom plate 100, which can therefore be raised with a negative pressure of a relatively small magnitude. A thin flexible sheet 60 is applied against the bottom surface of the bottom plate 100 for the same purpose as mentioned above. Again projections 61 are formed on the front end of the bottom plate to produce corrugations in the uppermost sheet attracted thereto, thus preventing a double sheet feeding.

While specific embodiments of the invention have been shown and described in detail to illustrate the application of the principles of the invention, it will be understood that the invention may be embodied otherwise without departing from such principles.

What is claimed is:

1. A pneumatic sheet feeder comprising:

a sheet receptacle on which a stack of sheets is placed, a vacuum casing disposed above the receptacle and defining a vacuum chamber having a bottom opening, at least one movable bottom plate adapted to close the bottom opening of the vacuum chamber and having air suction openings formed therein for applying a suction to a sheet in the stack, said movable bottom plate including a first bottom plate having its rear end pivotally mounted on a substantially horizontal first shaft which is disposed on the rear portion of the vacuum casing and adapted to close the rear half of the bottom opening, and a second bottom plate having its rear end pivotally mounted on a substantially horizontal second shaft disposed on the front portion of the first bottom plate and adapted to close the front half of the bottom opening, the second bottom plate being formed with said air suction openings, a support and elevator mechanism operable to position the bottom plate at a uniform angle of inclination relative to the receptacle independently of the height of the stack on the receptacle, an air suction device operable to draw air from the vacuum chamber to establish selectively a negative pressure within the chamber for raising the bottom plate when a sheet is held attracted thereto, feed means operable to feed the sheet which is held attracted to the bottom plate under the negative pressure, and drive means operable to selectively operate the feed means.

2. A pneumatic sheet feeder according to claim 1 in which the support and elevator mechanism comprises a linkage including a plurality of links which have their one ends pivotally connected with the bottom plate and the other ends pivotally connected with the vacuum casing.

3. A pnematic sheet feeder according to claim 2 in which the linkage comprises a link having one end pivotally connected with the vacuum casing, and a movable plate having its rear end pivotally connected with the vacuum casing.

4. A suction sheet feeder comprising:

a sheet receptacle on which a stack of sheets is placed, a vacuum casing disposed above the receptacle and defining a vacuum chamber having a bottom opening, at least one movable bottom plate adapted to close the bottom opening of the vacuum chamber and having air suction openings formed therein for applying a suction to a sheet in the stack, said movable bottom plate including a first bottom plate having its rear end pivotally mounted on a substantially horizontal first shaft which is disposed on the rear portion of the vacuum casing and adapted to close the rear half of the bottom opening, and a second bottom plate having its rear end pivotally mounted on a substantially horizontal second shaft disposed on the front portion of the first bottom plate and adapted to close the front half of the bottom opening, the second bottom plate being formed with said air suction openings, an air suction device operable to draw air from the vacuum chamber to establish selectively a negative pressure within the chamber for raising the bottom plate when a sheet is held attracted thereto, feed means operable to feed the sheet which is held attracted to the bottom plate under the negative pressure, and drive means operable to selectively operate the feed means.

5. A pneumatic sheet feeder according to claim 4 in which said feed means includes feed rollers rotatably mounted on a shaft which is carried by the movable bottom plate.

6. A pneumatic sheet feeder according to claim 5 in which said drive means comprises a driven gear fixedly mounted on a shaft on which the feed rollers are mounted, a drive gear disposed within the vacuum chamber and adapted to mesh with the driven gear when the rollers are raised to the given level together with the movable bottom plate, and a motor operable to selectively rotate the drive gear.

7. A pneumatic sheet feeder according to claim 4 in which the movable bottom plate is vertically movable so as to close the bottom opening of the vacuum chamber, said air suction openings being formed in the front portion of the bottom plate.

8. A pneumatic sheet feeder according to claim 4 in which the feed means partly project through the air suction openings to the underside thereof.

9. A pneumatic sheet feeder according to claim 4 in which the movable bottom plate is formed with projections on at least the front end of the bottom surface thereof, the projections being spaced apart in a direction transverse to the sheet feed direction.

10. A pneumatic sheet feeder according to claim 4 in which the sheet receptacle is provided with a front barrier carrying a rubber piece to prevent a double sheet feeding.

11. A pneumatic sheet feeder according to claim 1 in which the second bottom plate carries the feed means.

12. A pneumatic sheet feeder according to claim 1 in which the first bottom plate has one end of a thin flexible sheet secured thereto, the sheet having its free end depending into contact with the upper surface of a sheet in the stack at a position rearwardly of the feed means to block an airflow directed toward the air suction openings formed in the second bottom plate from the rear side of the feed means and an airflow into the vacuum chamber through the junction between the bottom plates.

13. A pneumatic sheet feeder comprising:

a sheet receptacle on which a stack of sheets is placed, a vacuum casing disposed above the receptacle and defining a vacuum chamber having a bottom opening, at least one movable bottom plate adapted to close the bottom opening of the vacuum chamber and having air suction openings formed therein for applying a suction to a sheet in the stack, a support and elevator mechanism operable to position the bottom plate at a uniform angle of inclination relative to the receptacle independently of the height of the stack on the receptacle, an air suction device operable to draw air from the vacuum chamber to establish selectively a negative pressure within the chamber for raising the bottom plate when a sheet is held attracted thereto, feed means operable to feed the sheet which is held attracted to the bottom plate under the negative pressure, drive means operable to selectively operate the feed means, and counteracting means connected with the movable bottom plate to impart a bias thereto which tends to raise it, the bottom plate bearing against the sheet receptacle with an effective weight which is reduced as a result of the balancing effect of the counteracting means.

14. A pneumatic sheet feeder according to claim 13 in which the counteracting means comprises a counterweight unit.

15. A pneumatic sheet feeder according to claim 14 in which the counterweight unit comprises a link having its one end pivotally connected with the movable bottom plate, a lever element having its one end pivotally connected with the other end of the link and also pivotally mounted on the vacuum casing, and a counterweight mounted on the other end of the lever element.

16. A pneumatic sheet feeder according to claim 15 in which the lever element extends through an opening formed in a partition located within the vacuum casing, the opening being closed by a thin metal sheet passing through the lever element.

17. A pneumatic sheet feeder according to claim 13 in which the counteracting means comprises a spring.

18. A pneumatic sheet feeder comprising:

a sheet receptacle on which a stack of sheet is placed, a vacuum casing disposed above the receptacle and defining a vacuum chamber having a bottom opening, at least one movable bottom plate adapted to close the bottom opening of the vacuum chamber and having air suction openings formed therein for applying a suction to a sheet in the stack, a support and elevator mechanism operable to position the bottom plate at a uniform angle of inclination relative to the receptacle independently of the height of the stack on the receptacle, a locking mechanism operable to selectively maintain the movable bottom plate at a given level, an air suction device operable to draw air from the vacuum chamber to establish selectively a negative pressure within the chamber for raising the bottom plate when a sheet is held attached thereto, feed means operable to feed the sheet which is held attracted to the bottom plate under the negative pressure, drive means operable to selectively operate the feed means, and said locking mechanism including a locking claw pivotally connected with the vacuum casing, an engaging element secured to the bottom plate and a ring carrying at least one unlock pin adapted to rotate as the drive means is energized.

19. A pneumatic sheet feeder according to claim 18 in which the locking claw has a holding lever which maintains it in its unlocked position.

20. A pneumatic sheet feeder according to claim 18 in which the engaging element comprises an anchorage secured to the movable bottom plate and a movable member pivotally connected with the anchorage.

21. A pneumatic sheet feeder according to claim 18 including a one-way clutch connecting the ring with the drive means.

22. A pneumatic sheet feeder according to claim 4, including a start switch, the air suction device being connected directly with the start switch, a delay circuit, said drive means being conected with the start switch through said delay circuit, whereby the drive means is started a given time interval after the movable bottom plate has been raised to a given level while holding a sheet attracted thereto.

23. A pneumatic sheet feed comprising:

a sheet receptacle on which a stack of sheets is placed, a vacuum casing disposed above the receptacle and defining a vacuum chamber having a bottom opening, at least one movable bottom plate adapted to close the bottom opening of the vacuum chamber and having air suction openings formed therein for applying a suction to a sheet in the stack, a support and elevator mechanism operable to position the bottom plate at a uniform angle of inclination relative to the receptacle independently of the height of the stack on the receptacle, an air suction device operable to draw air from the vacuum chamber to establish selectively a negative pressure within the chamber for raising the bottom plate when a sheet is held attracted thereto, feed means operable to feed the sheet which is held attracted to the bottom plate under the negative pressure, drive means operable to selectively operate the feed means, and, a thin flexible sheet having one end secured to one of the vacuum casing and the movable bottom plate and having another free end depending into contact with the upper surface of a sheet in the stack at a position rearwardly of the feed means thereby blocking an airflow directed toward the air suction openings in the bottom plate from the rear side of the feed means.

24. The suction sheet feeder according to claim 4 further comprising a thin flexible sheet having one end secured to one of the vacuum casing and the movable bottom plate and having another free end depending into contact with the upper surface of a sheet in the stack at a position rearwardly of the feed means thereby blocking an airflow directed toward the air suction openings in the bottom plate from the rear side of the feed means.

25. A suction sheet feeder comprising:

a sheet receptacle on which a stack of sheets is placed, a vacuum casing disposed above the receptacle and defining a vacuum chamber having a bottom opening, at least one movable bottom plate adapted to close the bottom opening of the vacuum chamber and having air suction openings formed therein for applying a suction to a sheet in the stack, an air suction device operable to draw air from the vacuum chamber to establish selectively a negative pressure within the chamber for raising the bottom plate when a sheet is held attracted thereto, feed means operable to feed the sheet which is held attracted to the bottom plate under the negative pressure, drive means operable to selectively operate the feed means, and locking means for locking said movable bottom plate at a predetermined position so that the sheets, which are being fed, are not held between the movable bottom plate and the receptacle when the sheets fed by said feed means and the negative pressure within the chamber is released, said locking means including a locking claw pivotally connected with the vacuum casing, an engaging element secured to the bottom plate and a ring carrying at least one unlock pin and adapted to rotate as the drive means is energized.

26. A pneumatic sheet feeder according to claim 25 in which the locking claw has a holding lever which maintains it in its unlocked position.

27. A pneumatic sheet feeder according to claim 25 in which the engaging element comprises an anchorage secured to the movable bottom plate and a movable member pivotally connected with the anchorage.

28. A pneumatic sheet feeder according to claim 25 including a one-way clutch connecting the ring with the drive means.

29. The pneumatic sheet feeder according to claim 23 further comprising locking means for locking said movable bottom plate at a predetermined position so that the sheets, which are being fed, are not held between the movable bottom plate and the receptacle when the sheets fed by said feed means and the negative pressure within the chamber is released, and solenoid means operatively connected to said locking means for selectively operating said locking means.

* * * * *